US005258078A

United States Patent [19]

Kinkelaar

[11] Patent Number: 5,258,078

[45] Date of Patent: Nov. 2, 1993

[54] METHOD AND COMPOSITION FOR DEPOSITING HEAVY IRON PHOSPHATE COATINGS

[75] Inventor: Edmund W. Kinkelaar, Dublin, Ohio

[73] Assignee: Texo Corporation, Cincinnati, Ohio

[21] Appl. No.: 898,413

[22] Filed: Jun. 15, 1992

Related U.S. Application Data

[62] Division of Ser. No. 477,491, Feb. 9, 1990, Pat. No. 5,137,589.

[51] Int. Cl.[5] ..... C23C 22/08

[52] U.S. Cl. ..... 148/259

[58] Field of Search ..... 148/259

[56] References Cited

U.S. PATENT DOCUMENTS 3,307,979 3/1967 Upham ..... 148/259

4,474,626 10/1984 052577392 ..... 148/259

*Primary Examiner*—Sam Silverberg

*Attorney, Agent, or Firm*—Francis T. Kremblas, Jr.

[57] ABSTRACT

An immersion bath composition and a method for applying a heavy, non-powdery coating of iron phosphate on a ferrous substance which is characterized by the addition of an effective amount of gluconic acid to a solution containing phosphoric acid, a soda ash, a chlorate or organic accelerator and water. Using conventional phosphating bath parameters, immersion of a ferrous substrate into the bath produces a heavy, strongly adherent, iron phosphate coating which is non-powdery or dust free and highly satisfactory for paint pre-treatment of the substrate surface.

8 Claims, No Drawings

METHOD AND COMPOSITION FOR DEPOSITING HEAVY IRON PHOSPHATE COATINGS

This is a division of my co-pending application, Ser. No. 07/477,491, filed Feb. 2, 1990, now U.S. Pat. No. 5,137,589.

TECHNICAL FIELD

The present invention relates generally to compositions and methods for producing iron phosphate coatings on ferrous substrates.

BACKGROUND ART

Phosphating ferrous substrates to produce an iron phosphate coating is an old and well-known art. Such coatings are typically employed to pretreat the surface of ferrous substrates prior to applying other protective coatings and aid in resisting corrosion.

In general, there are two types of phosphating processes well-known to those skilled in the art. One such process utilizes a bath solution which contains heavy metal ions such as iron, zinc and the like. This process is generally understood in the art to form an essentially crystalline coating wherein heavy metal ions initially present in the bath form a part of the coating. Examples of such processes are disclosed in prior U.S. Pat. Nos. 4,670,066; 4,474,626 and 4,728,373.

The other type of well-known phosphating process, sometimes referred to as the alkali metal phosphate process, utilizes a bath solution which contains no heavy metal ions and an essentially amorphous iron phosphate coating is formed which is generally satisfactory in applications wherein a relatively light or thin coating is acceptable. While such a coating includes a variable percentage of iron oxide, it is generally referred to as an iron phosphate coat by those skilled in the art.

It is also recognized by those skilled in the art that the mechanisms of coating formation is obviously different between the alkali metal phosphate system and the heavy metal phosphate system. The crystalline phosphate coating formed in the heavy metal type process is generally adherent and the coating thickness can be relatively heavy or thick without significant loss of its adherent nature. However, the heavy metal ions present in the bath composition represent a very difficult environmental waste disposal problem compared to the alkali metal phosphating systems.

With respect to the alkali metal systems, presently the two most often used methods of applying an essentially amorphous iron phosphate coating to substrates are a spraying process and an immersion process. One drawback to the spraying process is that it is typically limited to a relatively light or intermediate iron phosphate coating. A light coating is generally considered by those skilled in the art as about 35 mg per square foot or less. Intermediate coatings range from 35 mg to about 80 mg per square foot. The immersion process also provides a reasonably satisfactory iron phosphate coating for application of light and intermediate coatings. However, as one approaches the upper portion of this intermediate range, about 60 to 70 mg per square foot, the iron phosphate coatings tend to become less tightly held or bound to the substrate and "dusting" occurs. "Dusting" as referred to herein means an iron phosphate coat which is powdery and so poorly adherent or loosely bound to the substrate that the coating tends to become easily lost from the surface of the substrate. For those coatings referred to as heavy coatings by those in this field, that is above about 80 mg per square foot, the formation of a powdery coating becomes sufficiently severe as to extremely limit use of such coatings for many applications. Further, in some instances such loosely held, powdery coatings represent a serious health hazard in the workplace as iron phosphate dust can become airborne and may effect personnel working in the exposed area.

Prior to the present invention, it was well known to those skilled in the art that chlorate and organic accelerated alkali metal phosphating immersion baths produced heavy coatings, however, such coatings were loosely adhered particularly near the surface of the coatings and considered unsatisfactory. Inorganic accelerated baths tend to produce only relatively lighter coatings on a practical or cost efficient basis.

It has long been recognized that a thicker or heavier iron phosphate coating produced using a bath which contains no heavy metal ions is highly desirable to improve corrosion resistance of the substrate with or without the application of an additional protective coating, such as a paint or oil coat. However, poorly adherent, powdery coatings are generally unacceptable as a paint pre-treatment step due to the poor adhesion of the paint to the coating. Further, loosely held particles of the phosphate coating which are easily dislodged from the surface during handling and the like, represent a significant waste of the deposited coating and reduce the effectiveness of the coating process. The deposition of a satisfactory, heavy, amorphous iron phosphate coating useful for a wide variety of applications has been a significant and long standing problem to those skilled in the art.

The immersion process is recognized as the preferred method to apply a heavier phosphate coat because of the better control of time and consistency of the contact between the substrate and the phosphating bath, as well as more cost effective control of the other operative bath parameters. However, prior to the present invention, a satisfactory immersion bath composition, of the alkali metal type which provides a heavy, strongly adherent, non-powdery, amorphous iron phosphate coat has eluded those skilled in the art.

BRIEF DISCLOSURE OF INVENTION

The present invention relates generally to iron phosphate coating compositions and methods of application and particularly to a novel immersion bath composition containing no heavy metal ions, which is useful in a method of applying a heavy, non-powdery essentially amorphous iron phosphate coating which is tightly adhered to the substrate and resists dusting.

It has been discovered that the addition of gluconic acid to otherwise typical alkali metal iron phosphating bath components containing organic or chlorate type accelerators inhibits the formation of a powdery, loosely held, iron phosphate coating. When inorganic accelerators were used, the gluconic acid was not effective to an appreciable degree as the resultant thick or heavy coatings formed were loosely bound and easily rubbed off.

Preferred accelerators include hydroxylamine sulfate, nitrobenzene sulfonate, sodium chlorate or a suitable blend of sodium chlorate and sodium bromate. The most preferred accelerator appears to be hydroxylamine sulfate.

Amounts of gluconic acid in the bath composition which have been effective to provide heavy, non-powdery, strongly adherent coatings of 80 mg or more per square foot range between 2 to 5 percent on a weight basis to form a convenient to use, concentrated form of a preferred bath composition. The most preferred amount of gluconic acid as indicated in the most current tests results appears to be about 4 percent when a concentrate of the bath composition is formed.

The more conventional components of the immersion bath composition in accordance with the present invention include phosphoric acid, soda ash and water. Those skilled in the art recognize that other alkali metals can be substituted for soda ash in a conventional manner.

Typical bath parameters consistent with good industry standards for the type of immersion phosphating processes work well in accordance with the present invention. Bath temperatures between about 150 to 160 degrees F. and a pH of between 4.0 to 4.5 are preferred.

The time of immersion of the substrate in the bath depends upon the coating thickness desired. However, very good, strongly adherent coatings in excess of 100 mg per square foot have been relatively easily achieved in about 15 minutes in accordance with the present invention. On substrates subjected to conventional pickling pre-treatment, heavier, non-powdery coatings may be more quickly achieved.

OBJECTS

Therefore it is a primary object of the present invention to provide an improved phosphating immersion bath composition of the type not containing heavy metal ions wherein a heavy or thick, strongly adherent, non-powdery iron phosphate coating may be applied to a ferrous substrate which resists dusting of the coating from the substrate.

It is another object of the present invention to provide an immersion process for the application of a phosphate coating to a substrate which employs the novel bath composition referred to above herein.

It is further object of the present invention to provide a novel bath composition of the type described for use in an immersion process for applying a phosphate coating to a substrate wherein control of the formation of the coating is more effectively achieved to permit heavier, strongly adherent coatings to be applied as compared to prior art processes.

In describing the preferred embodiment of the invention specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

In accordance with the present invention, a novel phosphating immersion bath composition is formed by preparing a bath including phosphoric acid, soda ash, a chlorate or an organic accelerator and an amount of gluconic acid effective to inhibit the formation of poorly adherent iron phosphate powder when applying a heavy phosphate coating on the immersed substrate.

In formulating a convenient concentrated form in accordance with present invention, a preferred bath composition includes amounts of the above components in the following ranges, expressed in weight percent:

| | |
|---|---|
| 75% Phosphoric acid | 16–29 |
| Soda ash | 7–15 |
| Organic Accelerator | 3.5–6 |
| 50% Gluconic acid | 2–5 |
| Water | Balance |

Organic accelerators which work well in accordance with the present invention include hydroxylamine sulfate and nitrobenzene sulfonate. The most current test results indicate that hydroxylamine sulfate is the most preferred accelerator. Sodium Chlorate may be substituted as an acceptable accelerator in the range of 11 to 15 weight percent for the organic accelerators.

Baths prepared according to the description herein are preferably conventionally adjusted to a pH between 4.0 to 4.5.

It has long been known that the alkali metal phosphate immersion baths containing organic or chlorate accelerators will yield heavy iron phosphate coatings. Generally those skilled in the art consider heavy coatings as those of about 80 mg or greater per square foot. Those between about 35 mg to 80 mg per square foot are referred to as intermediate and those 35 mg or less per square foot are referred to as light coatings.

The use of inorganic phosphating accelerators such as molybdates or nitrates are used primarily to form light or intermediate coatings. As the weight of the phosphate coating approaches the higher end of the intermediate range, the tendency to form a poorly adherent iron phosphate powder on the surface of the coating becomes more pronounced. Then loss of the loosely held, powdery particles, referred to as dusting by those in this field, becomes a significant problem. The formation of such dust is generally considered as unacceptable in many pre-treatment applications and less desirable in most other applications. Further, the formation of such iron phosphate "dust" is often sufficient to be deemed an undesirable health hazard in the workplace. Airborne iron phosphate dust particles may be inhaled by those working in such an environment and cause potentially serious health problems.

However, it has been discovered that the addition of gluconic acid to organic or chlorate accelerated immersion phosphating baths of the present invention effectively eliminates any significant formation of iron phosphate powder or dust on the surface of the coating. The resultant immersion coatings in accordance with the present invention, employing typical immersion bath operating parameters, are tightly adherent. Such coatings in excess of 100 mg per square foot have been formed. Iron phosphate coatings as heavy as 200 mg per square foot have been obtained in development tests on pickled substrates and exhibit the non-powdery, strongly adherent characteristic previously not attainable in any prior art immersion process which deposits coatings as high as 80 mg or more per square foot.

In view of the failure of those skilled in the art to produce heavy, strongly adherent phosphate coatings from alkali metal bath compositions, this result is surprising and unexpected. Further, it represents a significant improvement in view of the long recognized desirability of such heavy, strongly adherent coatings for improvement of corrosion resistant and which are highly desirable for the application of a paint coat over the iron phosphate coating. Additionally, the dramatic reduction of "dusting" of the coat substantially eliminates a significant health hazard.

It should be noted that when conventional inorganic accelerators, such as molybdates or nitrates, were substituted for the organic or chlorate accelerators in the composition as described herein, the excellent results achieved according to the present invention did not occur. The coatings formed in the heavy range using inorganic accelerators exhibited the powdery, poorly adherent characteristic similarly obtained by the prior art.

Other tests were conducted employing versene acid and sodium glucoheptonate in substitution for gluconic acid. These substitutes were ineffective to inhibit the formation of loosely held, powdery coatings when the weight of the coating approached 80 mg per square foot or greater.

Therefore it appears that the combination of organic or chlorate accelerators and gluconic acid interact in some manner to effect the formation of heavy phosphate coatings which are strongly adherent and avoid formation of loosely held, powdery iron phosphate on the surface of the coating.

The operative phenomena of the immersion method of the present invention is not known, however, one theory is that the gluconic acid may modify the reaction rate to maintain the iron solubilized near the surface of the substrate to permit formation of strongly adherent deposits of iron phosphate rather than the dusty, loosely held, powder deposits. However, the inventor does not limit the invention to this or any other particular theory.

The following examples further illustrate the present invention and include preferred embodiments as set forth.

EXAMPLE I

An immersion bath was prepared incorporating the following components by weight percent:

| | |
|---|---|
| 75% Phosphoric Acid | 20% |
| Soda Ash | 7% |
| Hydroxylamine Sulfate | 5% |
| 50% Gluconic Acid | 4% |
| Water | Balance |

Water was added to dilute the above concentrate to a 3% bath composition. Conventional additives were used to adjust the pH of the bath to between 4.0 to 4.5. This bath composition appears to be the most preferred based upon the most current test results. Several ferrous panels were immersed in the bath between 15 to 30 minutes each at a bath temperature of between 150 to 160 degrees F. A coating of iron phosphate was formed on the panels ranging from 90 mg to 170 mg per square foot. An increase in the weight of the coating generally correlated to an increase of the time of immersion of the panel in the bath. Each of the iron phosphate coatings were strongly adherent, non-powdery and showed no perceived tendency to form an iron phosphate dust on the surface. After removal of each panel from the bath and drying, the coatings were tested by light wiping with a dry, clean cloth. The cloth then was closely examined to detect the presence of any iron phosphate. No appreciable amount of the coating was observed on the cloth.

EXAMPLE II

The procedure for preparing a bath identical to that described in Examples I was repeated except Nitrobenzene sulfonate accelerator was substituted for Hydroxylamine sulfate. Several ferrous panels were immersed in the bath for 15 minutes with the bath temperature between 150 to 160 degrees F.

The resulting iron phosphate coatings on each panel were in excess of 100 mg per square foot and were strongly adhered to the panel substrate. No significant formation of dust on the coating surface was observed nor was any significant amount of coating found on the wiping cloth used as described in Example I to test for dusting.

EXAMPLE III

The procedure described in Example II was repeated, however, the gluconic acid component was not included in the bath composition. The resulting iron phosphate coatings were less than 100 mg per square foot and were powdery. Very significant dusting on the surface of the coating which would render the iron phosphate unacceptable for a paint pre-treatment step was observed by conducting the cloth wiping test described in Example I. Further, tapping of the panels caused visually observable dusting of the coating from the surface of the panel.

EXAMPLE IV

A phosphating bath was prepared incorporating the following components by weight percent:

| | |
|---|---|
| 75% Phosphoric Acid | 25.8% |
| Soda Ash | 8.0% |
| Sodium Chlorate | 13.8% |
| 50% Gluconic acid | 2.0% |
| Water | Balance |

The above concentrated composition was diluted with additional water to form a 3% solution of the concentrate on a volume basis and the pH was adjusted as necessary to between 4.0 to 4.5. The operating bath temperature was maintained between 150 to 160 degrees F. Several panels were immersed for 15 minutes in the bath and an iron phosphate coating in excess of 100 mg per square foot was formed on each panel. The coatings formed were essentially identical to those formed in Example II, however, not quite as excellent as the coatings formed in Example I.

EXAMPLE V

The same procedures used in Examples I and IV were repeated with the exception that the gluconic acid component was not included in the bath compositions. The resulting iron phosphate coating were substantially identical to those results obtained in Example III regarding the powdery nature of the coating and the very significant formation of iron phosphate dust.

In all of the above examples, the substrate was pretreated in the well-known conventional manner employed in phosphating processes by cleaning with a suitable alkaline cleaner and rinsed with water prior to immersion in the phosphating bath. After immersion in the bath, another water rinse was used to remove the wet film of the phosphating bath. Normally, the substrate would then be treated with a chromate or nonchromate acidulated rinse to seal any small defects in the phosphate coating to cover any exposed bare metal.

It should be noted that a phosphating immersion bath prepared in accordance with the present invention may also be formulated with the addition of a conventional amount of detergent cleaner for those applications wherein it is deemed desirable to eliminate the separate alkaline cleaning and rinse steps without effecting the excellent results obtained. Further such baths do not contain any significant amount of heavy metal ions such as those compositions typically recognized to form a crystalline as opposed to an amorphous phosphate coating.

While certain preferred embodiments of the present invention have been disclosed in detail, it is to be understood that various modifications may be adopted without departing from the spirit of the invention or scope of the following claims.

I claim:

1. An improved iron phosphating immersion bath composition consisting essentially of, a) phosphoric acid;
b) soda ash;
c) an organic or chlorate based accelerating agent;
d) an amount of gluconic acid effective to inhibit the formation of a non-adherent iron phosphate powdery coating on a metal substrate immersed in said bath composition for a time sufficient to deposit at least 80 mg per square foot of the coating on the substrate; and
e) water.

2. The immersion bath composition defined in claim 1 wherein said accelerating agent is taken from a group consisting of hydroxylamine sulfate, nitrobenzene sulfonate and sodium chlorate.

3. A concentrate of the immersion bath composition defined in claim 1 consisting essentially of the following amounts of each component expressed in weight percent of the total concentrate:

a) 16 to 29 percent of seventy-five percent phosphoric acid;
b) 5 to 15 percent soda ash
c) 3 to 6 percent of an organic iron phosphating accelerator;
d) 2 to 5 percent of fifty percent gluconic acid; and
e) the balance water.

4. The concentrate defined in claim 3 wherein sodium chlorate is substituted for the organic accelerator recited in paragraph (c) in an amount ranging between about 11 to 15 weight percent.

5. The bath composition defined in claim 1 wherein the pH of said bath is at least between about 4.0 to about 4.5.

6. An improved iron phosphating bath composition of the type containing no substantial amount of heavy metal iron and comprising the following conventional components:

a) phosphoric acid;
b) alkali metal ions;
c) water;
d) an accelerating agent consisting essentially of an organic or chlorate based accelerating agent; the improved composition including an amount of gluconic acid in said bath sufficient to inhibit the formation of a non-adherent powdery iron phosphate coating on a metal substrate immersed in said bath composition for a time sufficient to deposit at least 80 mg per square foot of an amorphous iron phosphate coating on the substrate.

7. A concentrate of the immersion bath composition defined in claim 6 comprising the following amounts of each of said components expressed on a weight percent basis of the total concentrate;

a) 16 to 29 percent of seventy-five percent phosphoric acid;
b) 5 to 15 percent of a compound containing alkali metal ions;
c) 3 to 6 percent of an organic accelerating agent;
d) 2 to 5 percent of fifty percent gluconic acid; and
e) the balance water.

8. The concentrate defined in claim 6 wherein sodium chlorate is substituted for the organic accelerating agent in paragraph (c) in an amount ranging between about 11 to 15 percent.

* * * * *